United States Patent [19]

Miller

[11] 4,024,440

[45] May 17, 1977

[54] WATER ACTIVATED PRESSURIZED GAS RELEASE DEVICE

[75] Inventor: Francis M. Miller, Buffalo, N.Y.

[73] Assignee: Conax Corporation, Buffalo, N.Y.

[22] Filed: Feb. 13, 1975

[21] Appl. No.: 549,723

[52] U.S. Cl. ..... 361/251; 9/318; 137/392

[51] Int. Cl.[2] ..... F23Q 7/02

[58] Field of Search ..... 9/314, 317, 318; 317/80; 340/235, 309.1, 244 R, 244 C, 245; 307/118; 324/65 R; 102/16, 28; 137/392, 558

[56] References Cited

UNITED STATES PATENTS

| | | | |
|---|---|---|---|
| 3,291,046 | 12/1966 | Dahl | 102/28 |
| 3,426,942 | 2/1969 | McMains et al. | 9/318 |
| 3,438,326 | 4/1969 | Thomanek et al. | 317/80 |
| 3,580,158 | 5/1971 | Scholle et al. | 137/392 |
| 3,722,408 | 3/1973 | Fox et al. | 102/16 |

*Primary Examiner*—J. V. Truhe
*Assistant Examiner*—Clifford C. Shaw
*Attorney, Agent, or Firm*—Sommer & Sommer

[57] ABSTRACT

A water activated pressurized gas release device, especially suited for automatically controlling the release of the pressurized gas for inflating flotation equipment when dumped into water, which includes an electrically fireable primer for generating propulsion gas to drive a piercing pin into the closure of a container of pressurized gas to release the same, and fired by electrical energy derived from a battery arranged in a circuit maintained open on the ground side by electrically conductive elements providing two spaced apart electrodes until such space is filled with water for a predetermined duration of time as occurs upon immersion to close the circuit.

14 Claims, 5 Drawing Figures

WATER ACTIVATED PRESSURIZED GAS RELEASE DEVICE

BACKGROUND OF THE INVENTION

Electrical switches which can be made operative by contact with water are broadly known. However, the water sensitive electrical switches of the prior art are not fully satisfactory, especially for applictions for controlling the automatic inflation of flotation equipment when dumped into water. Inflatable equipment, such as a life vest or life raft, must be capable of being stored in a deflated condition for long periods of time and is only called upon in emergency situations. However, when such a situation arises it is most important that operation of the electrical switch to control inflation is assured.

Some prior art devices were battery operated but due to long standby the battery would deteriorate or would be ineffective to produce sufficient electrical energy, especially under low temperature conditions. Moreover, some prior art devices were complicated or of relatively large size and weight, or were too sensitive so that the electrical switch would actuate undesirably when the ambient relative humidity was high or the device was inadvertently splashed with water.

SUMMARY OF THE INVENTION

The foregoing disadvantages of prior art water sensitive electrical switch-like pressurized gas release devices are overcome by the present invention.

The primary object of the present invention is to provide a battery-operated water activated pressurized gas release device which has a long standby life and yet is capable of effective operation when immersed in water, whether fresh or salty.

Another important object is to provide such a device which will have a reasonably predictable delay time in activation so that it will not be sensitive to high humidity conditions, or casual water splashing, even brief momentary complete immersion.

Other objects and advantages are to provide such a device which is of small physical size, of low weight, is simple in construction and relatively inexpensive to manufacture.

The above objects and advantages, as well as others which will be apparent from the illustration in the accompanying drawings and ensuing description of a preferred embodiment of the present invention, are achieved by providing an electrical circuit comprising an electrically fireable primer in series with a breakdown diode, preferably in parallel with a capacitor and also with a resistance element, connecting said diode, capacitor and resistance element to the positive side of a battery, grounding the primer, capacitor and resistance element on an electrically conductive body which serves to support the various components of the device including the container of pressureized gas preferably also made of electrically conductive material, utilizing such body preferably with such conductive container as one electrode spaced from another electrode in the form of a sensor connected to the negative side of the battery, whereby the battery is maintained open on the ground side until water occupies the space between said electrodes for a sufficient length of time to close the circuit to allow the voltage on said diode to build up to breakdown level to fire the primer.

DETAILED DESCRIPTION OF THE PREFERRED EMBODIMENT ILLUSTRATED IN THE DRAWINGS

Figure 1:
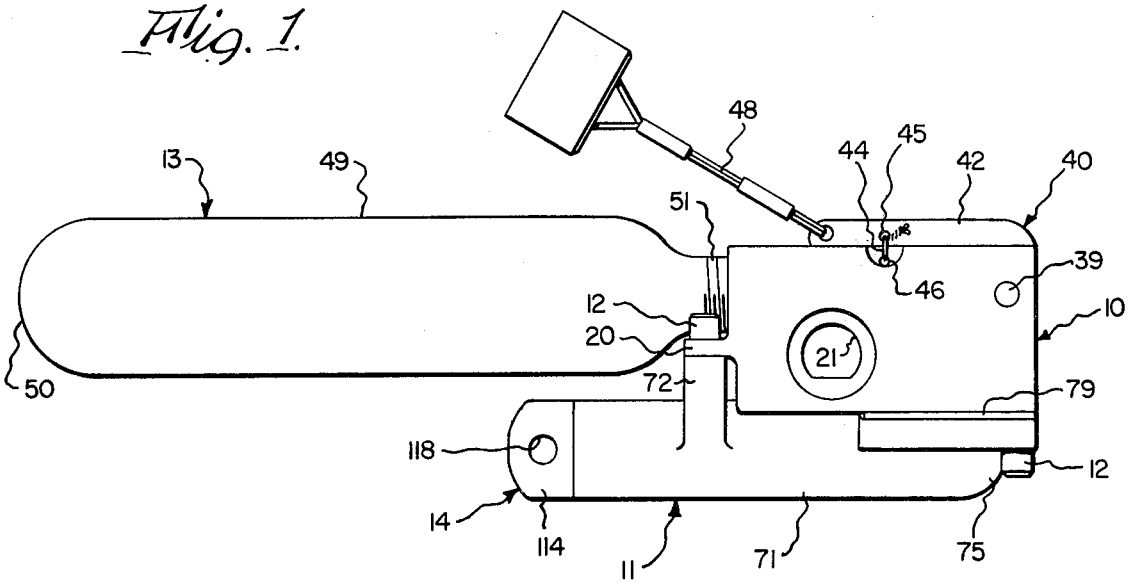
FIG. 1 is a side elevational view of a preferred embodiment of a water activated pressurized gas release device forming the subject of the present invention.

The preferred embodiment of the inventive water activated pressurized gas release device is shown in the drawings as including the general elements of a body 10, a housing 11 removably secured thereto by screws 12, a container 13 of pressurized gas replaceably mounted on the body, and a sensor plug 14 mounted on the housing.

Body 10 is shown as being in the general form of a flat-sided rectangular block composed of electrically conductive material such as aluminum, although any other suitable conductive material may be used. This block is shown as having a recess 15 along part of its upper surface, another recess 16 along its right side adjacent the upper right corner thereof, a flat lower surface 18, a partially cylindrical recess 19 in such surface at the lower left end, and an integral attaching flange 20 projecting outwardly from the left end of the body. A D-shaped transverse hole 21 extends from side to side through body 10 and is adapted to receive a stem (not shown) on the article to be inflated such as a life vest or life raft. The mode of gas conducting connection between the wall of hole 21 and such stem is well known to those skilled in the art.

Arranged above hole 21 is a longitudinally extending horizontal through bore 22 including an enlarged internally threaded left outer section 23, an inner section 24 of reduced diameter, and a right end section 25 of intermediate diameter, thus leaving an outwardly facing left shoulder 26 between sections 23 and 24 and a outwardly facing right shoulder 28 between sections 24 and 25. Slidably arranged in bore section 25 is a piercing pin 29 having an enlarged head 30 at its right end and a point 31 at its left end. A spring 32 surrounds the stem portion of pin 29 and has its left end bearing against shoulder 28 and its right end against head 30 so as to urge the piercing pin to the right. This head is shown as having an annular groove in its periphery in which an O-ring 33 is arranged for sealing engagment with the wall of bore section To the right of piercing pin 29 and also arranged in bore section 25 is a stem-shaped driver 34 having an enlarged head 35 at its right end formed with a partially spherical convex right end face 36. Head 34 has an annular groove in its periphery in which an O-ring 38 is arranged for sealing engagement with the wall of bore section 25.

Pivotally mounted on a transverse horizontal pivot pin 39 supported by the transversely spaced cheeks of body 10 left by recess 16 is an L-shaped cm lever 40 including a cam portion 41 and an elongated arm portion 42. The axis of pivot pin 39 is shown as intersecting the centerline of horizontal body bore 22. The edge of cam portion 41 has a rounded cam face 43 adapted to wipingly engage driver end face 36 when cam lever 40 is pivoted in a clockwise direction about the axis of pivot pin 39, as viewed in FIG. 2.

Figure 2:
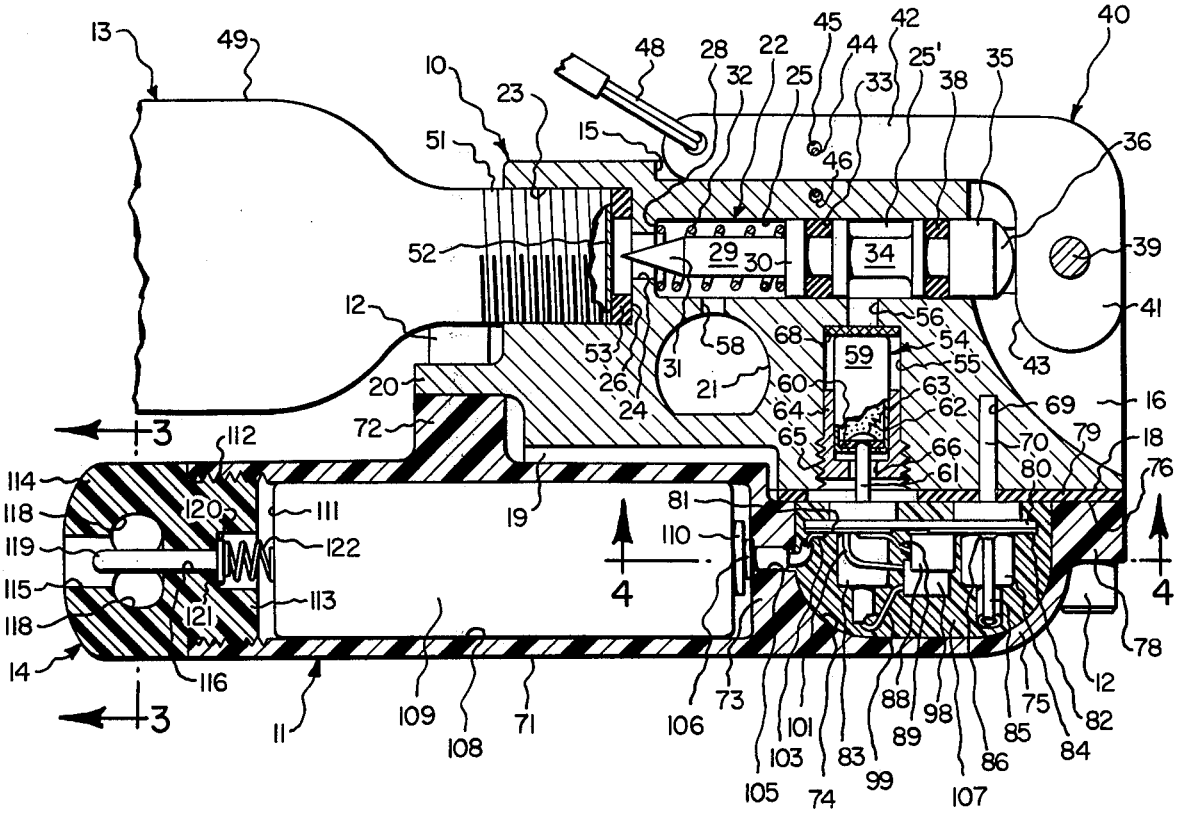
FIG. 2 is a fragmentary enlarged longitudinal central sectional view thereof, showing the container for confining a pressurized gas in elevation except for being broken away at its mounted end to reveal internal structure and showing the opposite end of the container broken away to allow the larger scale of illustration of the device.

Normally cam lever 40 is secured in the inoperative position shown in FIG. 2 by a relatively soft safety wire loop 44 passing through transverse holes 45 and 46 provided in this cam lever and body 10, respectively. A pull 48 is shown as suitably attached to the free or left end of arm portion 42 of the cam lever and is provided for manually pulling this arm portion upwardly so as to break the wire loop 44 and rotate cam lever 40 in a clockwise direction as viewed in FIG. 2. Spring 32 urges piercing pin 29 rightwardly against driver 34, in turn urged against cam lever 40 which acts as a stop.

Container 13 is shown as a bottle composed of suitable conductive material such as metal having an elongated cylindrical intermediate section 49, a spherical convex closed end 50 and an externally threaded reduced neck 51 at its opposite end. The mouth or outer end of this neck is suitably closed by a pierceable end wall or closure 52. Neck 51 is firmly screwed into bore section 23 against an annular seal gasket 53 seated on body shoulder 26. Closure 52 is positioned opposite the point 31 of retracted piercing pin 29 which may be driven forwardly or to the left either manually, by pulling on cam lever 40, or by firing a primer 54 as hereinafter described and explained, in order to release the pressurized gas, such as carbon dioxide, nitrogen or other suitable gas, confined within container 13.

Primer 54 is shown as arranged in a primer chamber 55 formed as a recess in body 10 from the lower surface 18 thereof. The upper end of this chamber 55 is shown as connected via an inlet passage 56 with the body bore section 25 immediately to the right or behind the head 30 of piercing pin 29. Body 10 is shown as having an outlet passage 58 communicating D-opening 21 with body bore section 25 in advance of or to the left of the head 30 on piercing pin 29.

Primer 54 is shown as comprising a burstable cup-shaped case 59 composed of electrically conductive material such as metal shown in inverted position in chamber 55. The lower end of the primer is closed by an insulation disk 60 whih carries an outstanding, here specifically a depending, electrically conductive pin contact 61. This pin contact is of sufficient length to extend below the level of body lower surface 18. One or more bridge wires 62 electrically connects the inner or upper end of in contact 61 with the wall of conductive case 59. This case is filled with a suitable ignitable material 63 which is ignited when a suitable current flows through bridge wire 62.

Primer 54 is shown as press-fitted into a cup-shaped plug 64 which is externally threaded adjacent its lower end so as to screw into an internally threaded portion 65 of chamber 55 at the lower end thereof. The bottom of plug 64 has a suitable hole 66 therein through which primer pin contact 61 extends without contacting this plug. The base of this plug is also shown as having a transverse slot 67 to receive the blade of a screw driver or other suitable tool to facilitate the insertion and removal of this plug. A filter disk 68 of metallic screening is shown arranged in chamber 55 between the upper end wall thereof and the upper closed end of the primer case 59. This disk prevents solid particles of larger than the filtered size to pass upwardly through passage 56 and, of course, allows flow of the gaseous products generated by ignition of the propellant material 63 in primer 54 when the latter is fired.

Body 10 is shown as provided with a vertical cylindrical recess 69 extending upwardly from the body's lower surface 18. In this recess is a press-fitted elongated cylindrical conductive ground pin 70 which extends downwardly below body surface 18. This ground pin 70 is parallel to the primer contact pin 61 and both project below surface 18 substantially the same distance.

Housing 11 is preferably made of an electrically non-conductive material such as a suitable plastic. It is shown as comprising a left end cylindrical barrel portion 71 from which an integral upstanding boss 72 rises having a flat upper surface. This boss 72 abuts against body attaching flange 20 and is provided with a pair of transversely spaced internally threaded recesses (not shown) to receive severally a pair of screws 12 which secure the flange to the boss, these srews extending through holes (not shown) in flange 20.

At the inner or right end of the housing barrel portion 71 is a partition or transverse wall 73 on the opposite or right side of which is a recess 74 formed in a right end housing portion 75. This recess 74 is generally dish-shaped, faces upwardly and opens to an upper flat surface 76 which is offset downwardly with respect to the crest of the housing barrel portion 71. Housing portion 75 has a rightwardly extendingintegral lip 78 provided with a pair of transversely spaced holes through each of which a screw 12 extends to be received in a threaded recess (not shown) provided in body 10. Housing surface 76 is opposite body surface 18 and therebetween a gasket 79 is clamped, having suitable openings to allow passage of pins 61 and 70 and access to the lower end of primer plug 64 when housing 11 is separated from body 10. All screws 12 are parallel to one another so that when removed housing 11 can be separated from body 10.

Electrical circuit means are shown arranged in recess 74 and as comprising a generally rectangular horizontal flat circuit board 80 of electrically non-conductive material having separate positive and negative electrically conductive plates 81 and 82, respectively, suitably secured to the lower side thereof. Board 80 supports a pair of sockets 83 and 84 arranged to extend therethrough and having their entrances facing upwardly and spaced apart to receive the primer contact pin 61 and the body ground contact pin 70, respectively. Socket 84 is electrically connected to negative plate 82 by a lead 85 soldered to this plate as indicated at 86. A capacitor 88 has one lead 89 soldered to positive plate 81 as indicated at 90, and its other lead represented by its case 91 soldered to negative plate 82 as indicated at 92. A resistance element 93 has one lead 94 soldered to positive plate 81 as indicated at 95, and its other lead 96 soldered to negative plate 82 as indicated at 97. A breakdown diode 98 has three terminals 99, 100 and 101, the first of which is connected to socket 83, the second of which is connected to nothing, and the third of which is soldered to positive plate 81 as indicated at 102. A lead wire 103 at one end is soldered to positive plate 81 as indicated at 104, extends through a central hole 105 in partition 73 and at its other end is suitably electrically connected to an eyelet contact 106 arranged against the left side of this partition. The electrical circuit means is preferably potted in housing recess 74 by a suitable insulation material such as and epoxy resin, indicated at 107, leaving the entrances to sockets 83 and 84 exposed above board 80 for penetration by contact pins 61 and 70, respectively.

The interior of housing barrel portion 71 forms a compartment 108 for a dry cell battery 109 having a positive contact 110 at its inner end and a negative contact 111 at its base. The outer end portion of this battery compartment is internally threaded as indicated at 112 to receive the externally threaded inner end portion 113 of plug 14 which is composed of an electrically non-conductive material. This plug is shown as having an enlarged head portion 114 provided with a cylindrical periphery having a diameter about the same as that for the periphery of housing barrel portion 71. A horizontal bore 115 having an intermediate section 116 of reduced diameter extends centrally through plug 14 from end to end. A series of circumferentially spaced equidistant radial holes 118, three being shown, lead from the periphery of the exposed head portion 114 to bore 115 outwardly of reduced bore section 116 as by a press-fit is an elongated cylindrical sensor or probe 119 made of electrically conductive material such as metal. At its inner end the pin-like sensor or probe 119 has a head 120 seated on the inwardly facing shoulder 121 formed between intermediate bore section 116 and the inner portion of bore 115. An electrically conductive lead in the form of a metal helical spring 122 is shown as soldered at one end to sensor head 120 and at its other end bears against the battery negative contact 111. When plug 14 is screwed fully into housing barrel portion 71, as shown in FIG. 2, spring 122 is in a compressed condition assuring good electrical contact with the battery and also urging the battery's positive contact 110 firmly into good electrical contact with eyelet contact 106.

Figure 3:
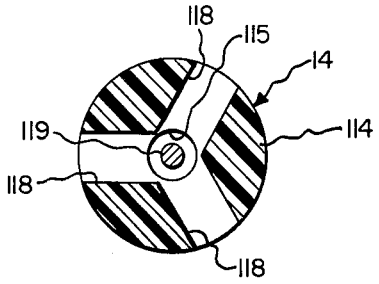
FIG. 3 is a vertical transverse sectional view of the sensor plug shown in FIG. 2 and taken on line 3—3 thereof.
Figure 4:
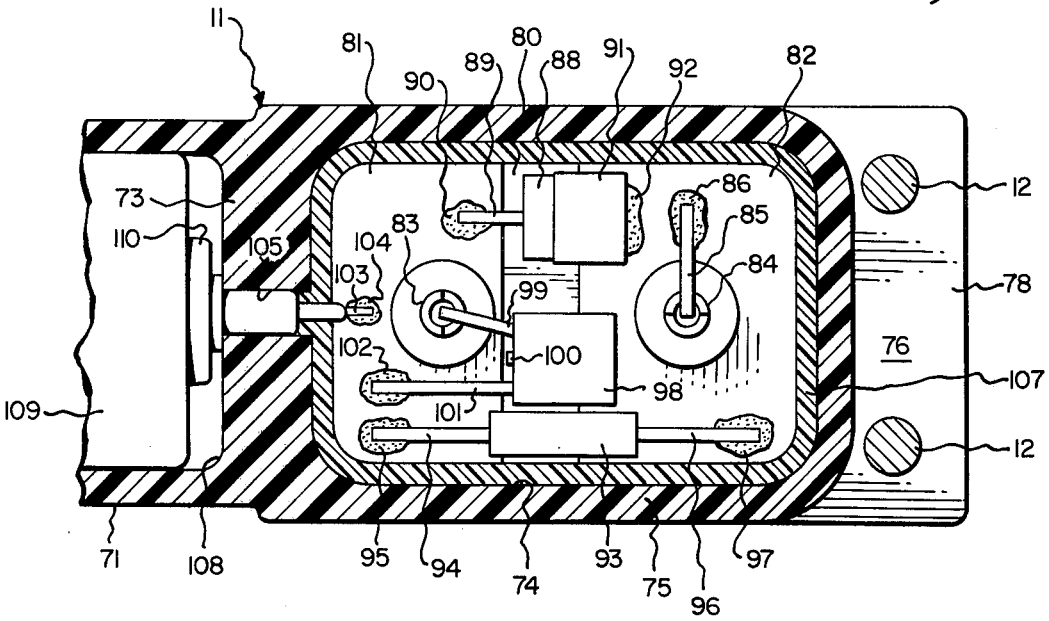
FIG. 4 is a still further enlarged fragmentary horizontal sectional view of the housing which is recessed to accomodate circuit means illustrated in elevation.

Referring to FIGS. 2 and 3 it will be seen that conductive /sensor or probe 119 projects into the outer portion of bore 115 in plug 14 and it is in radially spaced relation to the surrounding wall of this bore portion. Access to the sensor or probe 119 is provided by the open outer end of bore 115 and also by the radial holes 118 for a purpose hereinafter explained.

Figure 5:
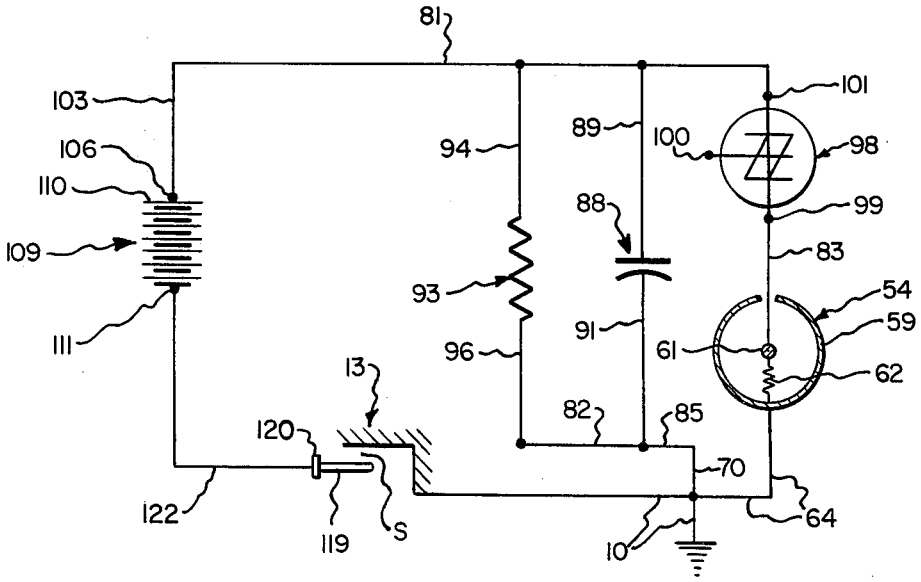
FIG. 5 is a circuit diagram of the inventive water activated pressurized gas release device.

FIG. 5 is a circuit diagram adapted to illustrate the various electrical and electronic components heretofore described. Thus, battery 109 has a positive contact 110 engaging contact 106 connected by lead 103 to positive plate 81. Leads 89 and 94 for capacitor 88 and resistance element 93, respectively, are conneted to positive plate 81, as is also terminal 101 of breakdown diode 98. Another terminal 99 of this diode is connected through socket 83 to primer contact pin 61. From this, current can flow through bridge wire 62 to the primer case 59 which is electrically connected through conductive plug 64 to the body 10 which represents ground. Electrically connected to this ground is the conductive gas bottle 13. The grounded body 10 has a contact pin 71 received in socket 84 which is electrically connected to negative plate 82. To this plate are also electrically connected the other leads 91 and 96 of the capacitor 88 and resistance element 93, respectively.

When water fills the space, represented by S in FIG. 5, between sensor 119 and container 13, a circuit is closed through the battery 109 and primer bridge wire 62 thereby firing the primer 54. The propulsion gas generated is filtered by disk 68, passes through passage 56 into that part 25' of body bore section 25 between heads 30 and 35. The driver 34 remains stationary, being backed up by locked-in-place cam lever 40. However, the pressurized gas in chamber 25' drives piercing pin 29 in a leftward direction so as to cause pin point 31 to pierce container closure 52. This allows the pressurized inflation gas confined within container 13 to escape, flowing through body bore section 24 into the portion of body bore section 25 occupied by spring 32, thence through outlet passage 58 to the point of use.

As an increasing voltage is applied across the normally open terminals 101, 99 of the breakdown diode 98, a voltage level is reached where the diode becomes operative to connect or close these terminals. This is the diode's breakdown voltage level. When the diode so breaks down a voltage is impressed across the primer bridge wire 62 and a firing current flows therethrough. After the circuit is broken, as by destruction of the bridge wire 62, diode 98 automatically resets to a normally open condition between its terminals 101 and 99. The third terminal 100 of the diode may be used in other applications for gating but is inutile here.

For practical reasons, the inclusion of the capacitor 88 in the circuit is preferred, as is the resistance element 93. When water fills space S it not only closes the circuit in the manner of a movable contact in a switch, but also inserts a resistance in series with capacitor 88. The effect of the two is to provide a time delay in the charging of this capacitor. Generally speaking, the higher the resistance afforded by the water filing space S, the longer the time delay. Thus, fresh water which offers more resistance than salty water will provide a longer time delay. Also generally speaking, the higher the capacitance of capacitor 88 the longer the time delay. The function of resistance element 93 is to bleed off any charge on capacitor 88, the higher the value of the resistance the slower the charge is bled off. As a practical matter, resistance element 93 gives protection against the cumulative charge of capacitor 88 due to successive splashes of water filling space S intermittently. Without resistance element 93 each splash could add incrementally to the charge on capacitor 88 until the breakdown voltage level on diode 98 might be reached causing it to become operative to fire primer 54 when not intended. It is also to be noted that the presence of capacitor 88 in the circuit renders the circuit immune to radio frequency interference to cause unintentional firing of the primer.

Accordingly, when the circuit is closed by water filling the space S for a sufficient length of time, capacitor 88 gradually builds up a charge until the breakdown voltage level of diode 98 is reached. As stated, the length of time required for this to occur is a function of the water resistance and the capacitance value of capacitor 88. Typically, it is designed to have a delay of about one second. Incidentally, it appears that neither the size of the electrodes defining space S nor the distance therebetween seems to affect the resistance afforded by the water filling such space.

The values of the capacitor 88 and resistance element 93 are selected to provide the length of time desired for firing the primer 54 after immersion of the device so as to fill the space S with water, to obtain an effective voltage on terminal 101 as a high percentage of the maximum voltage available from battery 109 and to be sure that the effective voltage is above the breakdown voltage of diode 98, and to control the rate of decay of energy left in the capacitor after primer firing. Without being limitative but to illustrate typical operative values, breakdown diode 98 may be a silicon bidirectional switch having a breakdown value of from 6 to 10 volts, such as one identified in the trade as Motorola MBS-4992; battery 109 may be a single 12 volt dc battery, or two 6 volt dc batteries in series, such as an Eveready No. 544 of the silver oxide type; capacitor 88 may have about a 47 microfarad capacitance with a working dc voltageof 10 volts, such as one identified in the trade a Kemet T421E476M010AU; resistance element 93 may be a conventional resistor having a resistance of about 0.10 megohms at room temperature, such as one made by Ohmite; and the bridge wire of prime 54 may have a resistance of 2–5 ohms and require at least 500 ergs to fire.

Where the device is intended for operation in a wide temperature range, such as from about −40° F. to about 140° F., it is preferred to employ a thermistor instead of a conventional resistor for the resistance element 93. A conventional resistor has an extremely low percentage change in resistance per degree of temperature change, and is usually positive. On the other hand, a thermistor is a resistance element made of a semiconducting material which exhibits a high negative temperature coefficient of resistivity, that is, as the temperature increases the resistivity, decreases, and vice versa. Accordingly, as used in this specification and the accompanying claims, "resistance element" is intended as a generic term to include either a conventional resistor or a thermistor.

In the illustrative example given above, a thermistor having a resistance of about 0.10 megohms at 25° C. such as one identified in the trade as Fenwall Electronics P/N PA51D1, may be used as the resistance element 93, if broad temperatures range operability is desired.

After firing, the device may be reused. This is accomplished by removing screws 12, separating housing 11 from body 10, the pin and socket connections 61, 83 and 70, 84 permitting of this, removing from body 10 the plug 64 with the fired primer 54 therein, replacing the fired prier with an unfired one, reinserting the plug with fresh primer into body 10, rejoining body 10 with housing 11 through their pair of pin and socket connections, reapplying screws 12, removing container 13 and replacing it with a charged and closed container. The piercing pin will have retracted after its previous firing due to the action of return spring 32. Removal of the device as a whole from a water-immersed environment will operate to reset breakdown diode 98.

From the foregoing, it will be seen that the present invention provides a water activated pressurized gas release device which has a normally open circuit on the negative side of the battery and therefore places no known drain on the battery when the device is in storage, and otherwise achieves the objects hereinabove recited. Manually controlled firing is made available as an alternative to automatic firing.

The particular embodiment illustrated and described is the best mode contemplated by applicant for carrying out his invention at the time of the filing this application. However, such embodiment is illustrative and not limitative of the invention the scope of which is intended to be measured by the appended claims.

What is claimed is:

1. In a water activated device including an electrically responsive element to be electrically energized, the combination therewith of an electrical energizing circuit comprising an electrical power source, a breakdown diode having a breakdown voltage level below the voltage level of said source, spaced electrodes, conductor means connecting said element, diode and electrodes in series with each other and with said source and arranged to provide a direct series connection between said element and diode, and a capacitor electrically connected directly across such directly connected element and diode, whereby the electrical resistance afforded by water filling the space between said electrodes operates in conjunction with said capacitor to provide a time delay for charging said capacitor up to said breakdown voltage level.

2. A device according to claim 1 wherein said diode is a bidirectional switch.

3. A device according to claim 1 which further comprises a resistance element electrically connected across said capacitor.

4. A device according to claim 3 wherein said resistance element is a thermistor.

5. A water activated pressurized gas release device, comprising a container of pressurized gas having a pierceable closure, a piercing pin movably arranged relative to said closure so that when actuated it pierces said closure to release the gas confined within said container, a primer for generating propulsive gas to actuate said pin, said primer including a case containing a quantity of ignitable material and a bridge wire having two ends, a battery having two contacts, a breakdown diode having two terminals one of which is electrically connected to one end of said bridge wire and the other of which is electrically connected to one contact of said battery, an electrical sensor electrically connected to the other contact of said battery, means providing an electrode electrically connected to the other end of said bridge wire and arranged in spaced relation to said sensor, and a capacitor having two terminals one of which is electrically connected to said other terminal of said diode and the other of which is electrically connected to said other end of said bridge wire, whereby when water occupies the space between said sensor and said electrode a closed circuit is established through said bridge wire to fire said primer.

6. A device according to claim 5 which further comprises a resistance element having two terminals one of which is electrically connected to said other terminal of said diode and the other of which is electrically connected to said other end of said bridge wire.

7. A device according to claim 6 wherein said resistance element is a thermistor.

8. A device according to claim 5 wherein said means providing an electrode further includes a body composed of electrically conductive material, said container is secured to said body, said piercing pin is arranged on said body, said case is composed of electrically conductive material and electrically connected to one end of said bridge wire, said primer further includes a primer contact insulated from said case and electrically connected to the other end of said bridge wire, said one of the diode terminals being electrically connected to said primer contact, said case being electrically connected to said body, and one terminal of said capacitor being electrically connected to one contact of said battery and the other terminal of said capacitor being electrically connected to said body.

9. A device according to claim 8 which still further comprises a resistance element electrically connected across said capacitor.

10. A device according to claim 9 wherein said resistance element is a thermistor.

11. A water activated pressurized gas release device, comprising a body of electrically conductive material having a mounting recess for a container, a piercing pin chamber generally coaxial with said mounting recess, inlet and outlet passages communicating with said piercing pin chamber at an axially spaced interval therealong, a first surface and a primer chamber recessed from said first surface and communicating with said piercing pin chamber through said inlet passage; a container of pressurized gas having a neck received in said mounting recess and a pierceable closure at the end of said neck; a piercing pin arranged in said piercing pin chamber in a retracted position and adapted to be driven toward said closure to pierce the same for release of the gas confined within said container for discharge through said outlet passage; a primer for generating propulsive gas to drive said piercing pin and including an electrically conductive case containing a quantity of ignitable material, a primer pin contact insulated from said case and a primer bridge wire electrically connecting said primer pin contact to said case, said primer being arranged in said primer chamber so that said case is grounded to said body and said primer pin contact projects outwardly from said first surface; a plug retaining said primer in said primer chamber; said body having a ground pin contact projecting outwardly from said first surface; a housing removably secured to said body and composed of electrically nonconductive material and having a second surface opposite said first surface, said housing having a circuit recess in said second surface and a battery recess separated from said circuit recess by a partition; a removable sensor plug closing the end of said battery recess remote from said partition and having a separable securement to said housing and also having an internal compartment provided with access holes leading to the exterior of said sensor plug when secured to said housing, said sensor plug being composed of electrically non-conductive material; an electrically conductive sensor carried by said sensor plug and projecting into said compartment; a battery arranged within said battery recess between said sensor plug and partition and having a battery positive contact adjacent said partition and a battery negative contact electrically connected to said sensor; electrical circuit means arranged within said circuit recess including a circuit board composed of electrically nonconductive material and having separate positive and negative plates arranged on one side thereof, a pair of sockets mounted on said board and having entrances exposed on the other side thereof, means electrically connecting said negative plate to one of said sockets which receives said body ground pin, a capacitor electrically connected across said plates, a resistance element electrically connected across said plates and a breakdown diode having two terminals, one of which is electrically connected to the other of said sockets which receives said primer pin contact and the other of said terminals being electrically connected to said positive plate, and means extending through said partition and electrically connecting said positive plate to said battery positive contact, whereby when water occupies the space between said sensor and body a closed circuit is established through said primer bridge wire to fire said primer.

12. A device according to claim 11 wherein said circuit means are potted in said circuit recess by an insulation material.

13. A device according to claim 12 wherein said container is elongated and composed of an electrically conductive material, said sensor is an elongated pin, and said mounting recess extends generally parallel to said sensor, whereby when water occupies the space between said sensor and said container a closed circuit is established through said primer bridge wire to fire said primer.

14. A device acording to claim 11 wherein said container is replaceable, and said plug retaining said primer is removable to permit replacement of said primer following separation of said body and housing permitted by such pin and socket connections, whereby the device is rendered reusable except for the aforementioned replacement components.

* * * * *